US005557814A

United States Patent [19]

Cybulski

[11] Patent Number: 5,557,814

[45] Date of Patent: Sep. 24, 1996

[54] BED SHEETING ARRANGEMENT

[76] Inventor: Stephen Cybulski, 784 Paul La., Plentywood, Mont. 59254

[21] Appl. No.: 436,606

[22] Filed: Jul. 24, 1995

[51] Int. Cl.[6] ..... A47G 9/02

[52] U.S. Cl. ..... 5/496; 5/479; 5/485

[58] Field of Search ..... 5/485, 486, 494, 5/496, 497, 498, 499

[56] References Cited

U.S. PATENT DOCUMENTS

| | | | |
|---|---|---|---|
| 3,832,743 | 9/1974 | Smith | 5/496 |
| 3,857,124 | 12/1974 | Hadley | 5/496 |
| 3,858,256 | 1/1975 | Beer | 5/496 |
| 4,389,744 | 6/1983 | Monroe | 5/496 |
| 4,615,061 | 10/1986 | Scott | 5/497 |
| 4,727,608 | 3/1988 | Joyce | 5/497 |
| 4,970,744 | 11/1990 | Davis | 5/497 X |
| 5,046,207 | 9/1991 | Chamberlain | 5/497 |

*Primary Examiner*—Michael F. Trettel

[57] ABSTRACT

The present invention discloses a bed sheeting arrangement having a fitted lower sheet and an attachable upper covering and an edge of a sidewall remote having a continuous inelastic drawstring in a channel which is moveable in the channel. A first end of the inelastic drawstring is constrained outside the channel and a second end of the inelastic drawstring is manually accessible outside the channel allowing the fitted lower sheet to be releasably attached to the mattress. The inelastic drawstring is of sufficient length so that movement of the second end varies the length of the inelastic drawstring lying in the channel alongside the sidewall edge to accommodate various sized mattresses. The body of the fitted lower sheet covers the top surface of the mattress and the ends and sides of the fitted lower sheet cover the ends and sides of the mattress when the fitted lower sheet is in place on the mattress. The fitted lower sheet has a first part of a two part releasable fastener which interengages with a second part of the two part releasable fastener secured to the upper covering. The bed sheeting arrangement has an upper covering with a second part of the two part releasable fastener such that the portion of the upper covering sidewall extending beyond the second part of the two part releasable fastener may be tucked under the foot end of the mattress.

9 Claims, 2 Drawing Sheets

BED SHEETING ARRANGEMENT

BACKGROUND OF THE INVENTION

The present invention relates to the general art of bedding, and to the particular field of bed sheeting arrangements.

The traditional form of bed sheeting has an upper and a lower sheet which are both formed from generally rectangular pieces of fabric and which are secured to a mattress by being tucked underneath the mattress. A fitted lower sheet is often used as a bottom sheet in a bed sheeting set. A fitted lower sheet generally includes a body having side and end portions which side and end portions fit around the sides and ends of a mattress so the fitted lower sheet encases the mattress. The body of the fitted lower sheet extends over the top of the mattress and the sides and ends of the fitted lower sheet extend for a short distance along the bottom of the mattress inwardly of the sides and ends of the mattress. While popular, many fitted lower sheets do not overcome problems associated the use of such fitted lower sheets.

One such problem concerns the neatness of the fit. Another such problem concerns the generally utilized elastic and stitching for fitting purposes becoming loose through normal use over a period of time. Another such problem is that of accommodating mattresses having a thickness or shape different from a thickness or shape for which the fitted lower sheet is designed.

Therefore, there is a need for a bed sheeting arrangement that combines the relative ease of handling of a non-fitted sheet with the convenience of a fitted lower sheet, and that can effectively accommodate any size or shape mattress in a secure manner.

It is an object of the present invention to provide a bed sheeting arrangement that combines the advantages of a non-fitted sheet with those of a fitted lower sheet without the usual disadvantages of a fitted lower sheet.

It is an object of the present invention to provide a bed sheeting arrangement that combines the advantages of a non-fitted sheet with those of a fitted lower sheet without the usual disadvantages of a fitted lower sheet and can securely accommodate a mattress.

It is an object of the present invention to provide a bed sheeting arrangement that combines the advantages of a non-fitted sheet with those of a fitted lower sheet without the usual disadvantages of a fitted lower sheet and a secured upper covering.

SUMMARY OF THE INVENTION

These and other objects are achieved by a bed sheeting arrangement having a fitted lower sheet and an attachable upper covering. The fitted lower sheet has a substantially rectangular central area with a foot end, a head end and a sidewall extending around the central area. The edge of the sidewall remote from the central area is provided with a continuous inelastic drawstring which is constrained to lie in a channel alongside the entire length of the sidewall edge, but is moveable in the channel along said sidewall edge. A first end of the inelastic drawstring is constrained outside the channel along the sidewall edge. A second end of the inelastic drawstring is manually accessible outside the channel allowing the fitted lower sheet to be releasably attached to the mattress. The inelastic drawstring is of sufficient length so that movement of the second end varies the length of the inelastic drawstring lying in the channel alongside the sidewall edge to accommodate various sized mattresses. The channel has a first opening from which the first end of the inelastic drawstring exits the channel, and a second opening from which the second end of the inelastic drawstring exits the channel. The channel may be either hemmed from that edge of the sidewall remote from the central area or may be formed of a slippery material such as silk or satin. The body of the fitted lower sheet covers the top surface of the mattress and the ends and sides of the fitted lower sheet cover the ends and sides of the mattress when the fitted lower sheet is in place on the mattress. In one embodiment of the present invention, the fitted lower sheet has a plurality of four elastic gathering strips attached to the edge of the sidewall remote from the central area.

The inelastic drawstring has a first end extending out of the channel at a first opening in the channel, said first end of the inelastic drawstring being constrained outside the channel along the sidewall. In one embodiment of the present invention, the first end of the inelastic drawstring constrained outside the channel along the sidewall edge is so constrained by being sewn onto the channel. In another embodiment of the present invention, the first end of the inelastic drawstring constrained outside the channel along the sidewall edge is constrained by means of the inelastic drawstring exiting the channel at the first opening in the channel and having a stopper attached to the inelastic drawstring outside of the channel, which stopper abuts but does not pass the first opening in the channel. The first opening in the channel is a reinforced eyelet opening in the channel.

The inelastic drawstring has a second end which is manually accessible outside the channel by which the inelastic drawstring allows the fitted lower sheet to be releasably attached to the mattress. The channel contains a second opening through which the second end of the inelastic drawstring extends to provide the manually accessible portion. The inelastic drawstring is of sufficient length so that shortening or lengthening the second end of the inelastic drawstring lying outside the second opening in the channel varies the length of the inelastic drawstring lying in the channel to accommodate various sized mattresses. The second opening in the channel is a reinforced eyelet opening in the channel.

The second end of the inelastic drawstring extends from the second opening in the channel between the fitted lower sheet and the mattress to which the fitted lower sheet is applied to exit the fitted lower sheet at a third opening, which third opening is a reinforced eyelet in the side or end of the fitted lower sheet. The second end of the inelastic drawstring has a sliding clasp attached thereto exterior of the third opening of the fitted lower sheet, which sliding clasp secures the length of the second end of inelastic drawstring when the inelastic drawstring is tightened by being pulled in a direction exterior of the fitted lower sheet. The second end of the inelastic drawstring may have an O-ring or other handle-type accommodation attached for purposes of pulling the inelastic drawstring in a tightening manner.

The fitted lower sheet has a first part of a two part releasable fastener secured to the side wall of the fitted lower sheet at the foot end thereof. The first part of the two part releasable fastener secured to the fitted lower sheet interengages with a second part of the two part releasable fastener secured to the upper covering.

The fitted lower sheet is easily placed on a mattress in the manner of a flat sheet, and the inelastic drawstring tightened by pulling the second end of the inelastic drawstring and securing the length so pulled by the sliding clasp thereon.

The inelastic drawstring is of sufficient length to allow for ease of mounting of the fitted lower sheet on the mattress. The second end of the inelastic drawstring is pulled in a direction exterior of the fitted lower sheet which tightens the inelastic drawstring within the channel. This pulling of the inelastic drawstring shortens the length of the channel and the sidewall edge of the fitted lower sheet on the mattress. The fitted lower sheet will move itself under the mattress in the proper position to snugly encase the mattress. The fitted lower sheet has an enclosable pocket which constrains the second end of the inelastic drawstring once the inelastic drawstring is pulled and secured so as provide for the fitted lower sheet to snugly encase the mattress. In one embodiment of the present invention, the enclosable pocket is enclosable by means of a zipper. The enclosable pocket provides for securing of the second end of the inelastic drawstring when the fitted lower sheet is being used or laundered.

When the fitted lower sheet is moved into proper position to snugly encase the mattress, the sliding clasp on the second end of the inelastic drawstring secures the length of the inelastic drawstring and thus the fitted lower sheet in proper position on the mattress.

The bed sheeting arrangement has an upper covering with a substantially rectangular central area, a head end and a foot end. The upper covering has a sidewall which extends from the central area at the foot end beyond a second part of a two part releasable fastener such that the portion of the sidewall extending beyond the second part of the two part releasable fastener may be tucked under the foot end of the mattress. The two part releasable fastener has the first part secured to the side wall of the fitted lower sheet at the foot end thereof and the second part secured to the foot end of the upper covering whereby the upper covering and fitted lower sheet can be releasably joined together at the foot end of the mattress. In one embodiment of the present invention, the two part releasable fastener comprises a zipper having two rows of interengageable teeth, with one row of interengageable teeth of the zipper let into the fitted lower sheet and a second row of interengageable teeth of the zipper let into the upper covering with the two rows of interengageable teeth of the zipper facing away from the space between the fitted lower sheet and the upper covering.

DESCRIPTION OF THE PREFERRED EMBODIMENT

Reference now should be made to the drawings in which the same reference numbers are used throughout the various figures to designate the same components.

Figure 1:
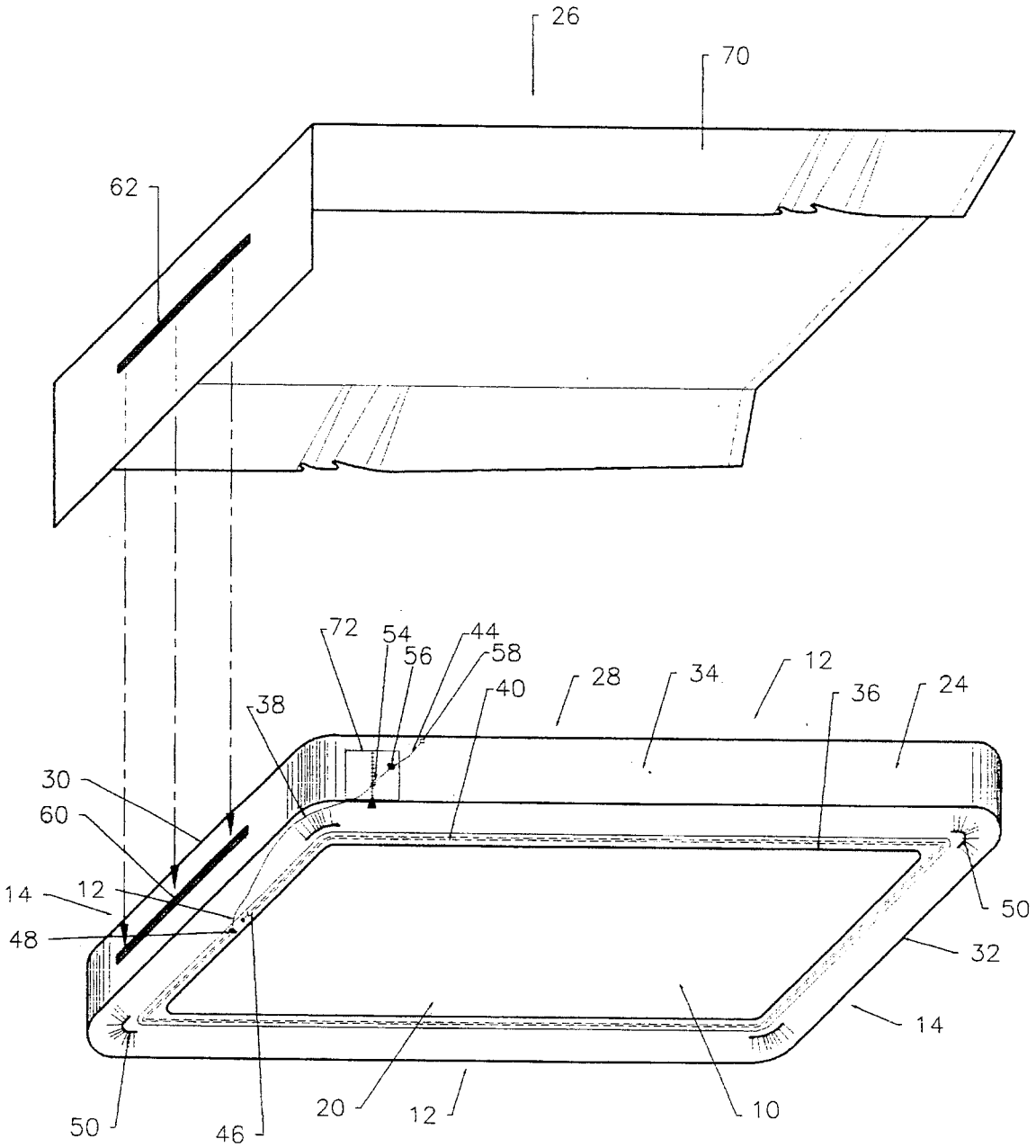
FIG. 1 is a perspective view of bed sheeting arrangement showing the fitted lower sheet and the upper covering.

FIG. 1 shows a mattress 10 having sides 12 and ends 14 which intersect each other at corners 16 of the mattress 10 and a top surface 18 and a bottom surface 20 separated by a thickness dimension of the mattress 10. The top surface 18 and bottom surface 20 are taken with reference to an in-use orientation of the mattress 10. No particular size or shape mattress is mandated with respect to the present invention and all sizes and shapes of mattresses can be used without departing from the scope of the present invention.

The mattress 10, shown in FIG. 1, has a bed sheeting arrangement according to the present invention comprising a fitted lower sheet 24 and an attachable upper covering 26. The fitted lower sheet 24 has a substantially rectangular central area 28 with a foot end 30, a head end 32 and a sidewall 34 extending around the central area 28. The edge 36 of the sidewall 34 remote from the central area 28 is provided with a continuous inelastic drawstring 38 which is constrained to lie in a channel 40 alongside the entire length of the sidewall edge 36, but is moveable in the channel 40 along said sidewall edge 36. A first end 42 of the inelastic drawstring 38 is constrained outside the channel 40 along the sidewall edge 36, and a second end 44 of the inelastic drawstring 38 is manually accessible outside the channel 40 so that the inelastic drawstring 38 allows the fitted lower sheet 24 to be releasably attached to the mattress 10 while also being of sufficient length so that movement of the second end 44 varies the length of the inelastic drawstring 38 lying in the channel 40 alongside the sidewall edge 36 to accommodate various sized mattresses. The channel 40 has a first opening 46 from which the first end 42 of the inelastic drawstring 38 exits the channel 40, and a second opening 48 from which the second end 44 of the inelastic drawstring 38 exits the channel 40. The channel 40 may be either hemmed from that edge 36 of the sidewall 34 remote from the central area 28 or may be formed of a slippery material such as silk or satin. The body of the fitted lower sheet 24 covers the top surface 18 of the mattress 10 and the ends 30,32 and the sides 34 of the fitted lower sheet 24 cover the ends 14 and sides 12 of the mattress 10 when the fitted lower sheet 24 is in place on the mattress 10. In one embodiment of the present invention, the fitted lower sheet 24 has a plurality of four elastic gathering strips 50 attached to corners on the edge 36 of the sidewall 34 remote from the central area 28.

Figure 2:
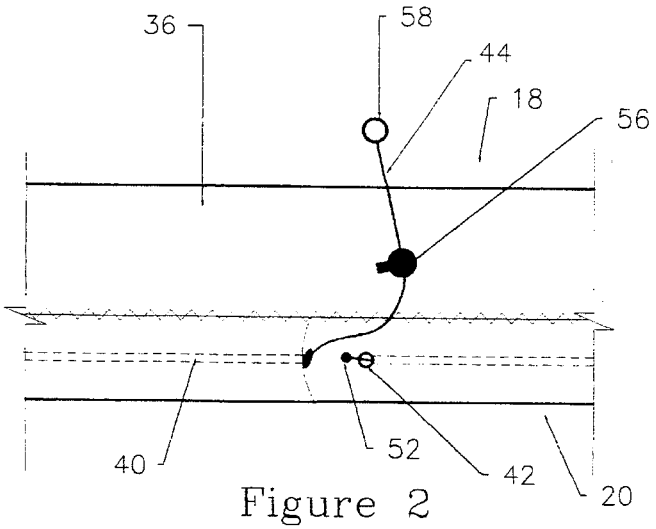
FIG. 2 is a blow up of one portion of the fitted lower sheet showing the openings in the channel with the first end of the inelastic drawstring having a stopper external the channel.
Figure 3:
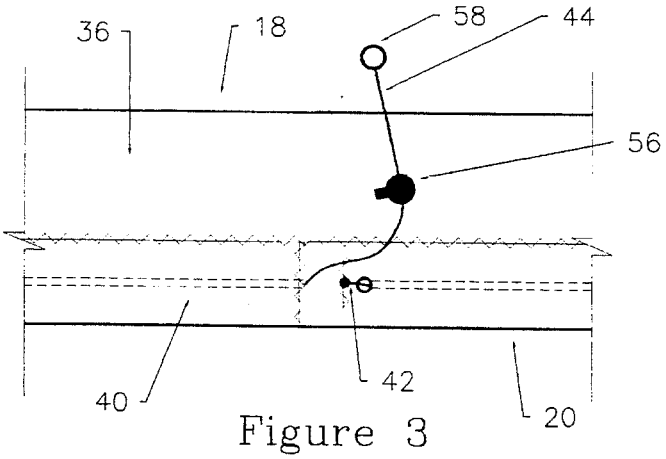
FIG. 3 is a blow up of one portion of the fitted lower sheet showing the openings in the channel with the first end of the inelastic drawstring being constrained by being sewn into the channel.

As shown in FIG.'S 2 and 3, the inelastic drawstring 38 has a first end 42 extending out of the channel 40 at a first opening 46 in the channel 40, said first end 42 of the inelastic drawstring 38 being constrained outside the channel 40 along the sidewall edge 36. In one embodiment of the present invention, the first end 42 of the inelastic drawstring 38 constrained outside the channel 40 along the sidewall edge 36 is constrained by being sewn onto the channel 40, as shown in FIG. 3. In another embodiment of the present invention, the first end 42 of the inelastic drawstring 38 constrained outside the channel 40 along the sidewall edge 36 is constrained by means of the inelastic drawstring 38 exiting the channel 40 at the first opening 46 in the channel 40 and having a stopper 52 attached to the inelastic drawstring 38 outside of the channel 40, which stopper 52 abuts but does not pass the first opening 46 in the channel 40, as shown in FIG. 2. The first opening 46 in the channel 40 is a reinforced eyelet opening in the channel 40.

As shown in FIG.'S 2 and 3, the inelastic drawstring 38 has a second end 44 which is manually accessible outside the channel 40 so that the inelastic drawstring 38 allows the fitted lower sheet 24 to be releasably attached to the mattress 10 while also being of sufficient length so that movement of the second end 44 varies the length of the inelastic drawstring 38 lying in the channel 40 alongside the sidewall edge 36 to accommodate various sized mattresses. The channel 40 contains a second opening 48 through which the second end 44 of the inelastic drawstring 38 extends. The second opening 48 in the channel 40 is a reinforced eyelet opening in the channel 40.

The second end 44 of the inelastic drawstring 38 further extends from the second opening 48 in the channel 40 between the fitted lower sheet 24 and the mattress 10 to which the fitted lower sheet 24 is applied to exit the fitted lower sheet 24 at a third opening 54, which third opening 54 is a reinforced eyelet. The second end 44 of the inelastic drawstring 38 has a sliding clasp 56 attached thereto exterior of the fitted lower sheet 24, which sliding clasp 56 secures the length of the second end 44 of inelastic drawstring 38 when the inelastic drawstring 38 is tightened by being pulled in a direction exterior of the fitted lower sheet 24. The second end 44 of the inelastic drawstring 38 may have an O-ring or other handle 58 attached for purposes of pulling the inelastic drawstring 38 in a tightening manner.

The fitted lower sheet 24 has a first part 60 of a two part releasable fastener secured to the sidewall 34 of the fitted lower sheet 24 at the foot end 30 thereof. The first part 60 of the two part releasable fastener secured to the fitted lower sheet 24 interengages with a second part 62 of the two part releasable fastener secured to the upper covering 26.

The fitted lower sheet 24 is easily placed on a mattress 10 in the manner of a flat sheet, and the inelastic drawstring 38 tightened. The inelastic drawstring 38 is of sufficient length to allow for ease of mounting of the fitted lower sheet 24 on the mattress 10. The inelastic drawstring 38 is pulled in a direction exterior of the fitted lower sheet 24 which tightens the inelastic drawstring 38 within the channel 40. This pulling of the inelastic drawstring 38 shortens the length of the channel 40 and the sidewall edge 36 of the fitted lower sheet 24. The fitted lower sheet 24 will move itself under the mattress 10 in the proper position to snugly encase the mattress 10.

Figure 4:
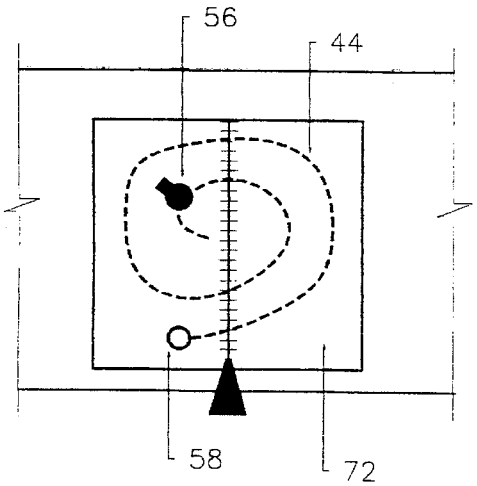
FIG. 4 is a blow up of one portion of the fitted lower sheet showing the closed enclosable pocket constraining the second end of the inelastic drawstring.
Figure 5:
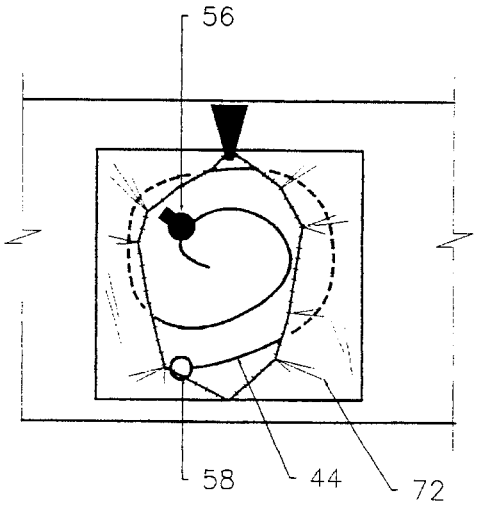
FIG. 5 is a blow up of one portion of the fitted lower sheet showing the open enclosable pocket constraining the second end of the inelastic drawstring.

When the fitted lower sheet 24 is moved into proper position to snugly encase the mattress 10, the sliding clasp 56 secures the length of the inelastic drawstring 38 thus securing the fitted lower sheet 24 in proper position on the mattress 10. As shown in FIGS. 4 and 5, the fitted lower sheet 24 has an enclosable pocket 72 which constrains the second end 44 of the inelastic drawstring 38 once the inelastic drawstring 38 is pulled and secured so as provide for the fitted lower sheet 24 to snugly encase the mattress 10, with FIG. 4 showing the encolsable pocket 72 closed, and FIG. 5 showing the enclosable pocket 72 open. In one embodiment of the present invention, the enclosable pocket 72 is enclosable by means of a zipper. The enclosable pocket 72 provides for securing of the second end 44 of the inelastic drawstring 38 when the fitted lower sheet 24 is being used or laundered.

The bed sheeting arrangement has an upper covering 26 with a substantially rectangular central area 64 and a head end 66 and a foot end 68. The upper covering 26 has a sidewall 70 which extends from the central area 64 at the foot end 68 beyond a second part 62 of a two part releasable fastener such that the sidewall 70 extending beyond the second part 62 of the two part releasable fastener may be tucked under the foot end 14 of the mattress 10. The two part releasable fastener has the first part 60 secured to the sidewall 34 of the fitted lower sheet 24 at the foot end 30 thereof and the second part 62 secured to the foot end 68 of the upper covering 26 whereby the upper covering 26 and fitted lower sheet 24 can be releasably joined together at the foot of the bed. In one embodiment of the present invention, the two part releasable fastener comprises a zipper having two rows of interengageable teeth, with one row of interengageable teeth of the zipper let into the fitted lower sheet 24 and a second row of interengageable teeth of the zipper let into the upper covering 26 with the two rows of interengageable teeth of the zipper facing away from the space between the fitted lower sheet and the upper covering.

The foregoing description of the preferred embodiment of the invention are to be considered as illustrative and not as limiting. Various changes and departures may be made to the invention herein without departing from the spirit and scope thereof. Accordingly, it is not intended that the invention herein be limited to that specifically described in the specification or as illustrated in the drawings, but only as set forth in the claims. From the drawings and above-description, it is apparent that a bed sheeting arrangement constructed in accordance with the invention herein provides desirable features and advantages. While the form of the invention herein described constitutes a preferred embodiment, it is to be understood that the bed sheeting arrangement herein are capable of further modification, and this application is intended to cover any variations, uses, or adaption of the bed sheeting arrangement herein, following in general the principles of the bed sheeting arrangement herein and include such departures from the present disclosure as to come within knowledge or customary practice in the art to which the bed sheeting arrangement herein pertain, and as may be applied to the essential features hereinbefore set forth and falling within the scope of the bed sheeting arrangement herein or the limits of the appended claims.

What is claimed and desired to be secured by United States Letters Patent is:

1. A bed sheeting arrangement for placement on a mattress, said bed sheeting arrangement comprising:

a fitted lower sheet and an attachable upper covering for placement on said mattress;

said fitted lower sheet having a substantially rectangular central area, said substantially rectangular area having a foot end, a head end and a sidewall extending around said central area;

said sidewall having an edge remote from said central area, said edge having a channel containing a continuous inelastic drawstring which continuous inelastic drawstring is constrained to lie in said channel the entire length of said edge;

said channel having a first opening therefrom;

said inelastic drawstring having a first end exiting said channel through said first opening, said first end being constrained outside said channel along said sidewall edge;

said channel having a second opening therefrom;

said inelastic drawstring having a second end exiting said channel through said second opening, said second end being manually accessible outside said channel;

said fitted lower sheet having a third opening;

said second end of said inelastic drawstring exiting said third opening in said fitted lower sheet;

said second end of said inelastic drawstring having a stopper, said stopper being attached to said second end outside said third opening in said fitted lower sheet;

said second end of said inelastic drawstring having a handle;

said fitted lower sheet having an enclosable pocket, said enclosable pocket providing for securing of said second end of said inelastic drawstring; and, said fitted lower sheet having a first part of a two part releasable fastener attached to said foot end thereof, said first part interengaging said upper covering.

2. The bed sheeting arrangement as claimed in claim 1 wherein said fitted lower sheet further comprises a plurality of four elastic gathering strips attached to said edge of said sidewall remote from said central area.

3. The bed sheeting arrangement as claimed in claim 1 wherein said channel further comprises a channel hemmed from said edge of said sidewall remote from said central area.

4. The bed sheeting arrangement as claimed in claim 1 wherein said channel further comprises a channel formed of a slippery material such as silk or satin.

5. The bed sheeting arrangement as claimed in claim 1 wherein said first end of said inelastic drawstring being constrained outside said channel along said sidewall edge is constrained by being sewn into said channel.

6. A bed sheeting arrangement as claimed in claim 1 wherein said first end of said inelastic drawstring being constrained outside said channel along said sidewall edge is constrained by means of a stopper attached to said first end outside of said channel.

7. A bed sheeting arrangement as claimed in claim 1 wherein said first opening, said second opening, and said third opening each comprise a reinforced eyelet.

8. A bed sheeting arrangement for placement on a mattress, said bed sheeting arrangement comprising:

a fitted lower sheet and an attachable upper covering for placement on said mattress;

said fitted lower sheet having a substantially rectangular central area, said substantially rectangular area having a foot end, a head end and a sidewall extending around said central area;

said sidewall having an edge remote from said central area, said edge having a channel containing a continuous inelastic drawstring which continuous inelastic drawstring is constrained to lie in said channel the entire length of said edge;

said channel having a first opening therefrom;

said inelastic drawstring having a first end exiting said channel through said first opening, said first end being constrained outside said channel along said sidewall edge;

said channel having a second opening therefrom;

said inelastic drawstring having a second end exiting said channel through said second opening, said second end being manually accessible outside said channel;

said fitted lower sheet having a third opening;

said second end of said inelastic drawstring exiting said third opening in said fitted lower sheet;

said second end of said inelastic drawstring having a stopper, said stopper being attached to said second end outside said third opening in said fitted lower sheet;

said second end of said inelastic drawstring having a handle;

said fitted lower sheet having an enclosable pocket, said enclosable pocket providing for securing of said second end of said inelastic drawstring; and, said fitted lower sheet having a first part of a two part releasable fastener attached to said foot end thereof, said first part interengaging a second part of said two part releasable fastener on said upper covering;

said upper covering having a substantially rectangular central area;

said substantially rectangular area of said upper covering having a head end, a foot end, and a sufficient length to extend beyond said foot end of said fitted lower sheet;

said foot end of said upper covering having a sidewall; and, said sidewall of said upper covering having said second part of said two part releasable fastener attached thereto, said second part of said two part releasable fastener securing to said sidewall of said upper covering the first part of said two part releasable fastener attached to said foot end of said fitted lower sheet.

9. The bed sheeting arrangement of claim 8 wherein said two part releasable fastener comprises a zipper having two rows of interengageable teeth, said two rows of interengageable teeth being let into said fitted lower sheet and said upper covering with said teeth of said zipper facing away from the space between said fitted lower sheet and said upper covering.

* * * * *